US008607931B2

(12) United States Patent
Grey

(10) Patent No.: US 8,607,931 B2
(45) Date of Patent: Dec. 17, 2013

(54) COMPRESSIBLE ACCOMMODATION LADDER AND RELATED METHODS

(75) Inventor: Thomas J. Grey, Jacksonville, FL (US)

(73) Assignee: Manson Construction Co., Seattle, WA (US)

( * ) Notice: Subject to any disclaimer, the term of this patent is extended or adjusted under 35 U.S.C. 154(b) by 162 days.

(21) Appl. No.: 13/071,204

(22) Filed: Mar. 24, 2011

(65) Prior Publication Data

US 2012/0241254 A1 Sep. 27, 2012

(51) Int. Cl.
*B63B 17/00* (2006.01)

(52) U.S. Cl.
USPC ..... 182/132; 114/362; 52/6; 52/9

(58) Field of Classification Search
USPC ..... 114/362; 182/159, 132; 52/182, 183, 52/6–10, 191
See application file for complete search history.

(56) References Cited

U.S. PATENT DOCUMENTS

| | | | | | |
|---|---|---|---|---|---|
| 2,803,841 | A * | 8/1957 | Wellens | 14/71.1 |
| 3,306,053 | A * | 2/1967 | Fulton | 405/215 |
| 3,570,029 | A * | 3/1971 | Hunsaker | 114/362 |
| 3,763,808 | A * | 10/1973 | Smith, Sr. | 114/266 |
| 3,808,625 | A * | 5/1974 | Fowler | 14/71.1 |
| 4,011,615 | A * | 3/1977 | Maxson et al. | 14/71.1 |
| 4,153,137 | A * | 5/1979 | Johnson | 182/97 |
| 4,293,967 | A * | 10/1981 | Ord | 114/362 |
| 4,412,403 | A * | 11/1983 | LeFranc et al. | 52/9 |
| 4,989,691 | A * | 2/1991 | Wilkerson et al. | 182/70 |
| 5,586,516 | A * | 12/1996 | Hagen et al. | 114/362 |
| 5,592,801 | A * | 1/1997 | Balzer | 52/741.2 |
| 5,829,380 | A * | 11/1998 | Smith | 114/362 |
| 6,524,050 | B1 * | 2/2003 | Arntzen et al. | 414/140.3 |
| 6,609,544 | B1 * | 8/2003 | Williamson | 141/387 |
| 6,643,879 | B1 * | 11/2003 | Davis | 14/69.5 |
| 6,802,684 | B2 * | 10/2004 | Arntzen et al. | 414/140.3 |
| 6,868,799 | B2 * | 3/2005 | Wright | 114/343 |
| 6,923,140 | B1 * | 8/2005 | Cook | 114/362 |
| 6,941,889 | B1 * | 9/2005 | McCrocklin et al. | 114/362 |
| 7,950,096 | B2 * | 5/2011 | Williamson | 14/69.5 |
| 7,996,942 | B2 * | 8/2011 | Fleischer et al. | 14/69.5 |
| 8,006,337 | B2 * | 8/2011 | Birmingham et al. | 14/71.1 |
| 2003/0041792 | A1 * | 3/2003 | Besenzoni | 114/362 |
| 2005/0284043 | A1 * | 12/2005 | Sorenson | 52/182 |
| 2006/0225372 | A1 * | 10/2006 | Gonzalez | 52/182 |
| 2009/0050045 | A1 * | 2/2009 | Grimaldi | 114/362 |
| 2009/0100614 | A1 * | 4/2009 | Dale et al. | 14/71.3 |
| 2012/0183359 | A1 * | 7/2012 | Nordstrom et al. | 405/205 |

* cited by examiner

*Primary Examiner* — Katherine Mitchell
*Assistant Examiner* — Colleen M Chavchavadze
(74) *Attorney, Agent, or Firm* — Arthur G. Yeager

(57) ABSTRACT

An accommodation ladder includes a body having opposite sides, an upper, and rear and bottom surfaces. The body is formed of a compressible material, such as dense foam material, and the upper surface of the body forms a staircase with a plurality of steps. Spaced stanchions extend upwardly from the staircase and stanchion pipes extend through the body and receive lines therethrough to secure the body to a marine structure. The spaced stanchions are adapted to accommodate a plurality of releasable safety lines therebetween. A method of facilitating access between adjacent first and second marine structures includes arranging the staircase accommodation ladder between the structures, the accommodation ladder being a fender between such structures.

4 Claims, 6 Drawing Sheets

COMPRESSIBLE ACCOMMODATION LADDER AND RELATED METHODS

FIELD OF THE INVENTION

The present invention relates to apparatus and methods for facilitating access between adjacent marine structures, and more particularly, to accommodation ladders.

BACKGROUND OF THE INVENTION

Facilitating access between wharves, piers and the like and adjacent marine vessels, as well as between two or more adjacent marine vessels, can be a complicated endeavor. Changes in adjacent vessels, draft, tides, wake and wave action, among other factors, result in an ever-shifting relationship in all three dimensions. Existing accommodation ladders, gangways and the like can be insufficient to easily allow for such changes.

SUMMARY OF THE INVENTION

In view of the foregoing, it is an object of the present invention to provide an improved accommodation ladder and related methods. According to an embodiment of the present invention, an accommodation ladder includes a body having generally opposed first and second sides, an upper surface, a rear surface and a bottom surface. The body is formed of a compressible material, such as foam, and the upper surface of the body forms a staircase with a plurality of steps, each step having a riser portion and a tread portion.

To secure the body to the marine structure, one or more pipes can extend through the body between the riser portion of one of the plurality of steps and the rear surface, such that a line can be passed therethrough. A "marine structure" as used herein includes marine vessels as well as shore- or seafloor-mounted structures against which marine vessels are brought. Non-limiting examples of shore- or seafloor-mounted structures include piers, wharves, docks, dry docks, and platforms. A "marine vessel" as used herein includes any waterborne structure, whether powered or unpowered. Non-limiting examples of marine vessels include ships, barges, floating platforms and hulks.

For the enhanced ease of use, the accommodation ladder can further include a plurality of spaced stanchions extending upwardly from the staircase, the stanchions being adapted to accommodate a plurality of safety lines therebetween.

According to a method aspect of the present invention, a method of facilitating access between adjacent first and second marine structures includes arranging the accommodation ladder in the form of a staircase between the first and second structures, the accommodation ladder also acting as a fender between the first and second structures.

Arranging the accommodation ladder between the first and second structures preferably includes securing the accommodation ladder to the first structure. In response relative level changes between the first and second structures, safety lines can be selectively removed and replaced between stanchions of the accommodation ladder proximate the second structure to allow easy access to different levels of the accommodation ladder.

The present invention is particularly well suited for facilitating access between a dredge and a succession of fleeting barges during dredging operations.

These and other objects, aspects and advantages of the present invention will be better appreciated in view of the drawings and following detailed description of a preferred embodiment.

DETAILED DESCRIPTION OF A PREFERRED EMBODIMENT

Figure 1:
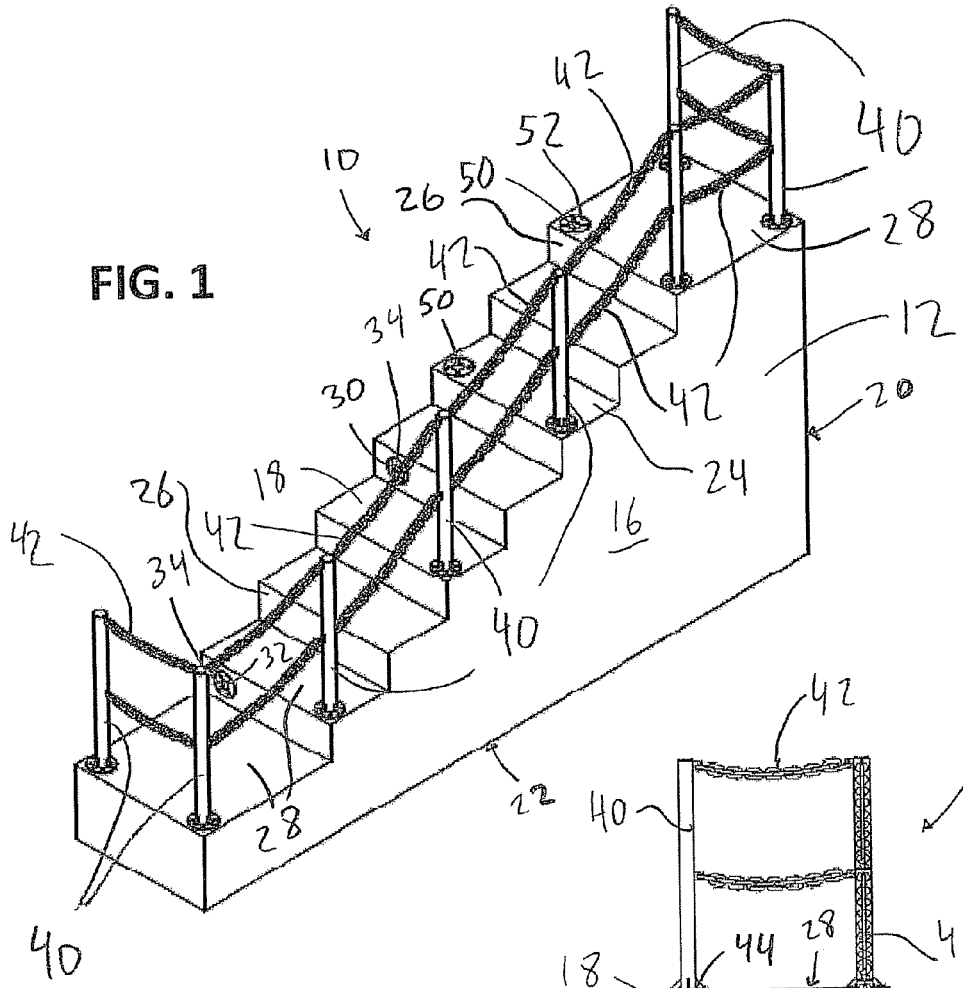
FIG. 1 is a perspective view of a compressible accommodation ladder according to an embodiment of the present invention.
Figure 2:
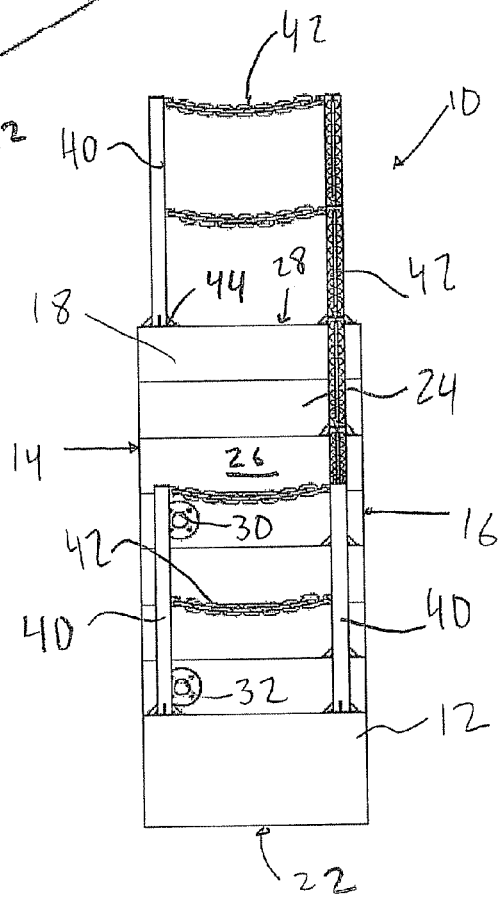
FIG. 2 is a front view of the accommodation ladder of FIG. 1.
Figure 3:
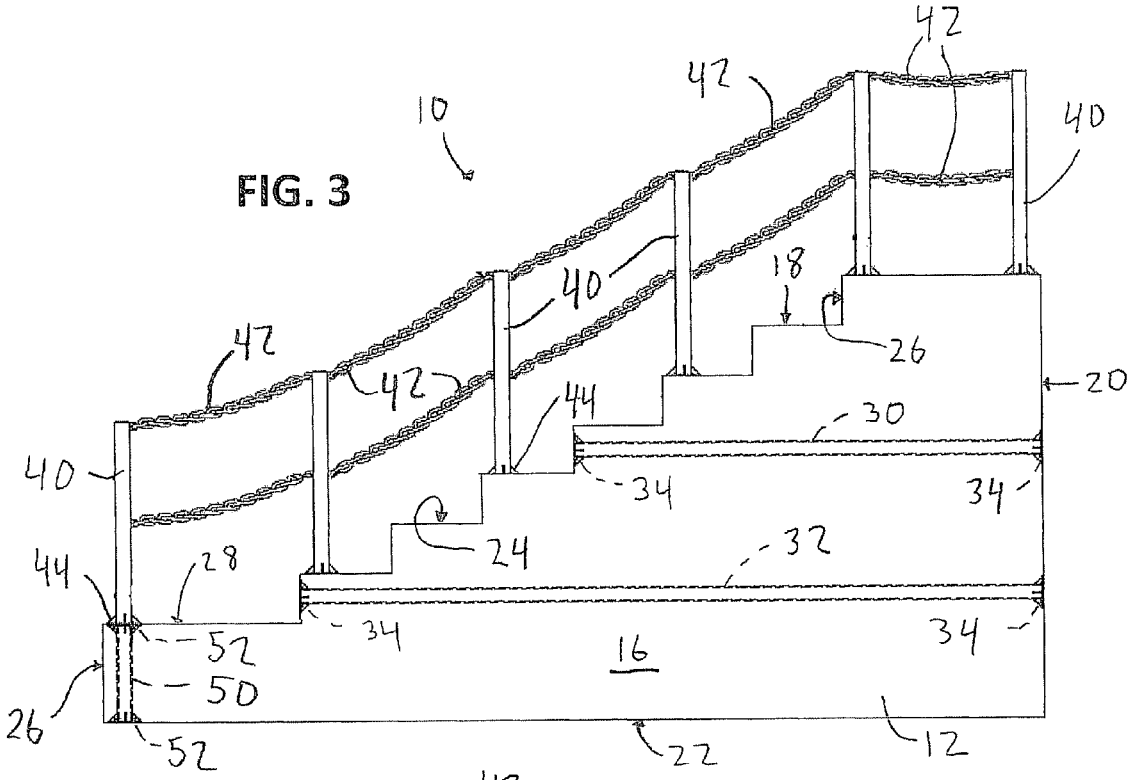
FIG. 3 is a side view of the accommodation ladder of FIG. 1, with hidden components shown in broken lines.
Figure 4:
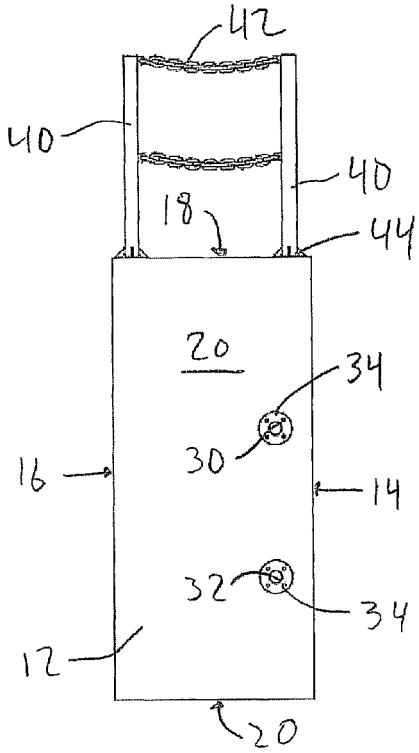
FIG. 4 is a rear view of the accommodation ladder of FIG. 1.

Referring to FIGS. 1-4, according to an embodiment of the present invention, an accommodation ladder 10 includes a body 12, having generally opposed first and second sides 14, 16, an upper surface 18, a rear surface 20 and a bottom surface 22. The upper surface 18 extends between the first and second sides, and forms a staircase 24 having a plurality of steps. Each step includes a riser portion 26 and a tread portion 28. The body 12 is formed of a compressible material, allowing the accommodation ladder 10 to compress between the first and second sides 14, 16 of the body, thereby also functioning as a fender.

The accommodation ladder 10 is preferably adapted for securing to a marine structure. To this end, the accommodation ladder 10 can further include first and second pipes 30, 32 extending through the body 12 between the rear surface 20 and riser portions 26 of respective steps of the staircase 24. To help retain the first and second pipes 30, 32 within the body 12, flanges 34 are located as respective ends thereof.

Lines can be passed through the first and second pipes 30, 32 to secure the body 12 to the marine structure hereinafter more fully described with respect to FIG. 5. As used herein, "line" is not necessarily limited to any particular material or construction thereof. Non-limiting examples of lines include ropes and chains.

For the convenience and safety of users, restraints are preferably provided on the staircase 24. For example, the accommodation ladder 10 can advantageously include a plurality of spaced stanchions 40 extending from tread portions 28 of the steps of the staircase 24. The stanchions are adapted to accommodate a plurality of safety lines 42 therebetween. Preferably, the safety lines 42 are selectively removable between adjacent stanchions 40, for reasons described in detail below. Additionally, each stanchion 40 preferably includes a flange 44 on a lower end thereof.

To facilitate secure attachment of the stanchions 40 to the body 12, a plurality of stanchion pipes 50 extend into the body 12 below each of the stanchions 40. Preferably, each stanchion pipe 50 extends between the tread portion 28 of its respective stanchion 40 and the bottom surface 22 (an exemplary one of the stanchion pipes 50 is shown in broken lines in FIG. 3; it will be appreciated that stanchion pipes 50 for stanchions on higher steps would be longer to extend between their respective steps and the bottom surface 22).

To help retain each stanchion pipe 50 within the body 12, each stanchion pipe 50 has flanges 52 at opposite ends thereof. Additionally, at upper ends thereof, each flange 52 is releasably connected to a corresponding flange 44 on the lower end of the respective stanchion 40. In an alternate configuration, the stanchions 40 could extend into and/or through the body 12 without a separate stanchion pipe 50.

Figure 5:
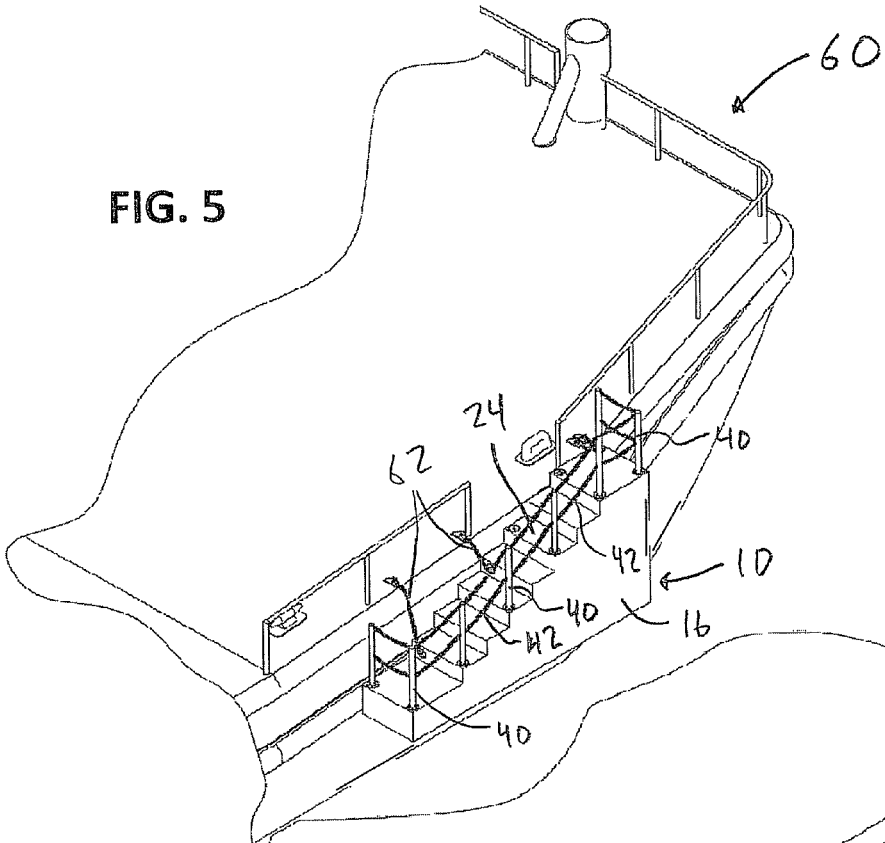
FIG. 5 is a perspective view of the accommodation ladder of FIG. 1, secured to a first marine structure.

Referring to FIG. 5, in use, the accommodation ladder 10 is secured to a first marine structure 60, such as a dredging barge, by lines 62. Stanchions 40 and safety lines 42 are arranged to allow access to the staircase 24 from the first side 14, while minimizing inadvertent falls and offering support along the second side 16 and at the top and bottom of the staircase 24. The presence of the marine structure 60 generally prevents falls from the first side 14, although additional stanchions 40 and safety lines 42 can be provided on the first side 14, depending on user preferences and/or the physical characteristics of the first marine structure. In such construction, stanchion pipes 50 are also provided along the first side 14 for this purpose (see FIG. 1).

Figure 6:
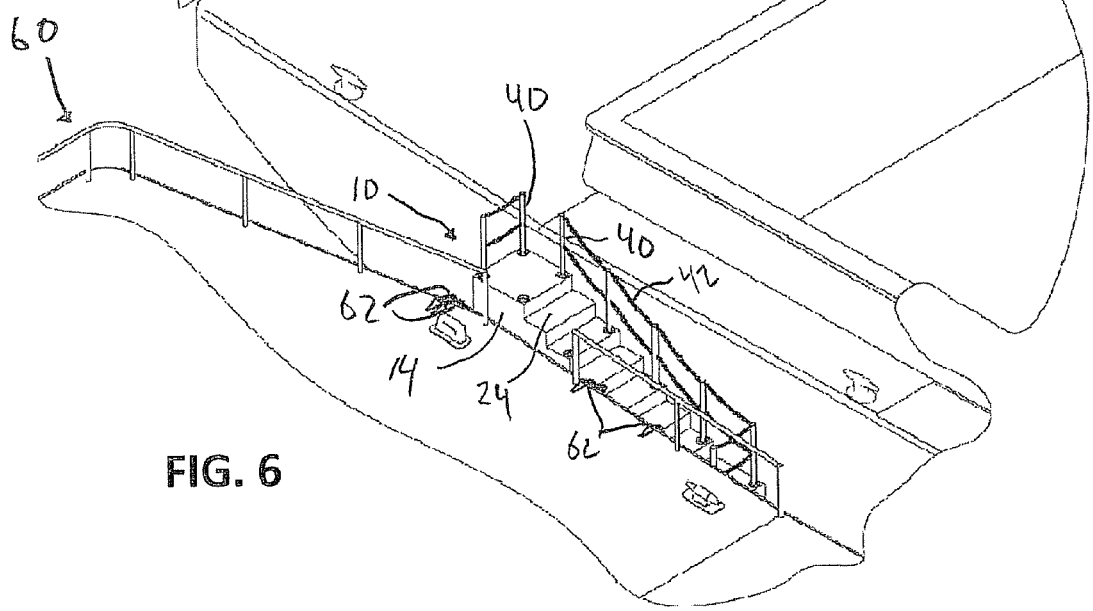
FIG. 6 is a perspective view of the accommodation ladder of FIG. 1, in a first configuration between the first marine structure and a second marine structure.

Referring to FIG. 6, a second marine structure 70, such as a fleeting barge for receiving dredged material from the dredging barge, is brought alongside the first marine structure 60 with the accommodation ladder 10 therebetween. The compressibility of the accommodation staircase ladder 10 will allow it to double as a fender, and will help prevent damage to the ladder 10 and adjacent marine structures 60, 70 by absorbing impact energy.

In FIG. 6, the deck of the second marine structure 70 sits higher than the deck of the first marine structure 60. To allow access from the staircase 24 to the second marine structure, the safety lines 42 are removed or dropped at one end thereof from between the upper two stanchions 40 on the second side 16. In one possible scenario, the draft of the second marine structure 70 increases, lowering its deck level relative to the deck level of the first marine structure 60.

Figure 7:
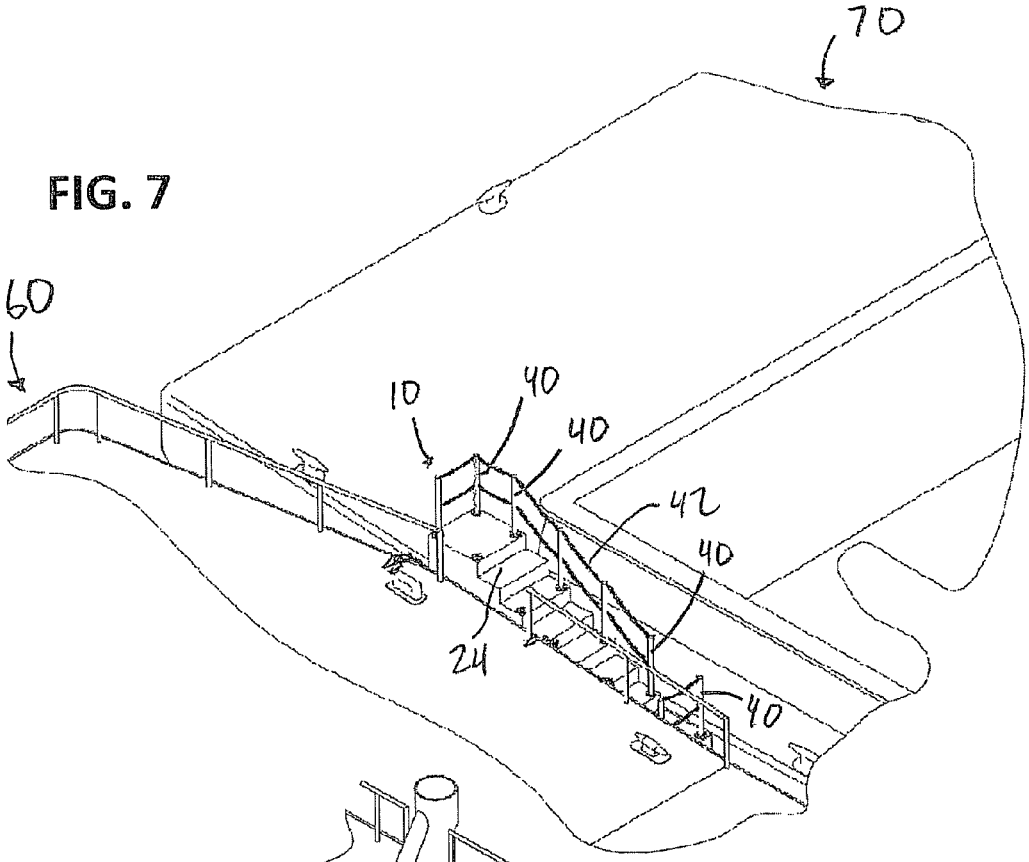
FIG. 7 is a perspective view of the accommodation ladder of FIG. 1, in a second configuration between the first marine structure and the second marine structure.

As the level lowers, the safety lines 42 are replaced or reconnected at one end thereof between the uppermost two stanchions 40 on the second side and removed between an appropriate lower pair of stanchions. In FIG. 7, for example, the safety lines 42 are removed between the lowermost two stanchions 40 on the second side 16, allowing access therebetween to the second marine structure 70.

Figure 8:
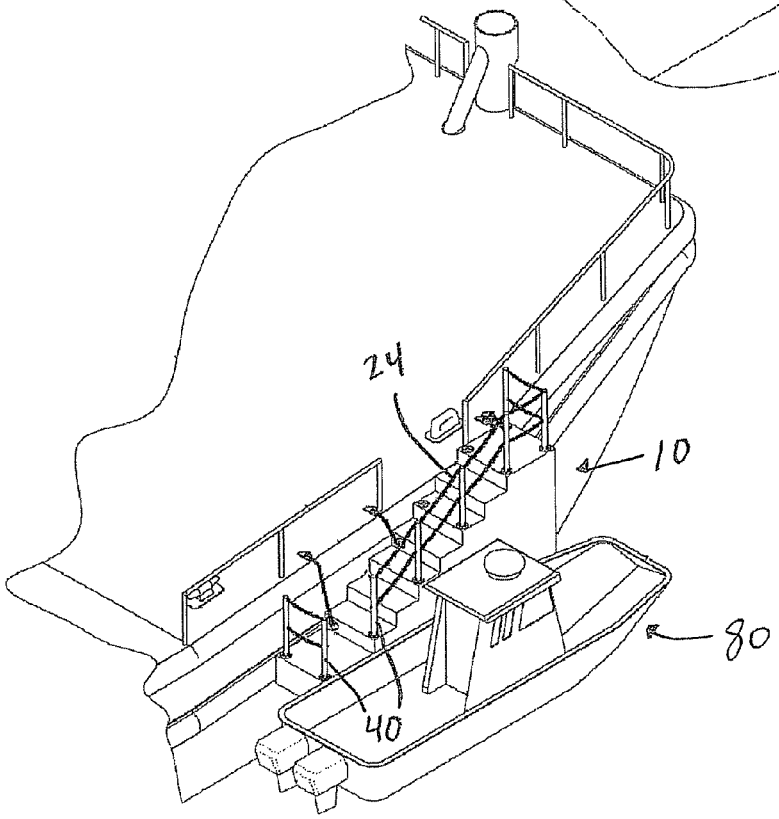
FIG. 8 is a perspective view of the accommodation ladder of FIG. 1, in the second configuration between the first marine structure and another second marine structure.

It will be appreciated that the foregoing is only one of many scenarios in which the accommodation ladder 10 can be advantageously employed. For example, referring to FIG. 8, access between the first marine structure and another second marine vessel 80, such as a crew boat, can be facilitated by the accommodation ladder 10. Additionally, the accommodation ladder 10 could be readily secured to another marine structure, such as a wharf or pier to facilitate access thereto from a ship or other marine vessel.

As noted, the body 12 of the accommodation ladder is made from a compressible material. Dense plastic foam material or rubber material are preferred materials, although the present invention is not necessarily limited thereto. For example, the staircase can be fabricated from thick slabs of such materials and joined together and resulting in the staircase depicted.

Where foam material is used, a preferred assembly method is the bonding of a plurality of foam slabs to form the body, with the height of each slab equal to the riser height of the staircase 24 (except for the riser of the bottom step, which is preferably made thicker—for instance, about twice the height of the other risers). The various pipes 30, 50 are inserted and bonded to the foam. The foam assembly is coated in a polymer material, such as polyurethane on all sides. A hot plate can be used to rough up the coating on the tread portions 28 of the steps to form a non-skid surface.

Advantageously, the compressible accommodation staircase ladder 10 is positively buoyant, so that the accommodation ladder 10 will not sink if it comes loose from an associated marine structure. Additionally, the accommodation ladder 10 can be moved and secured to marine structures in the absence of crane support by towing it through the water to a desired location for installation.

Figure 9:
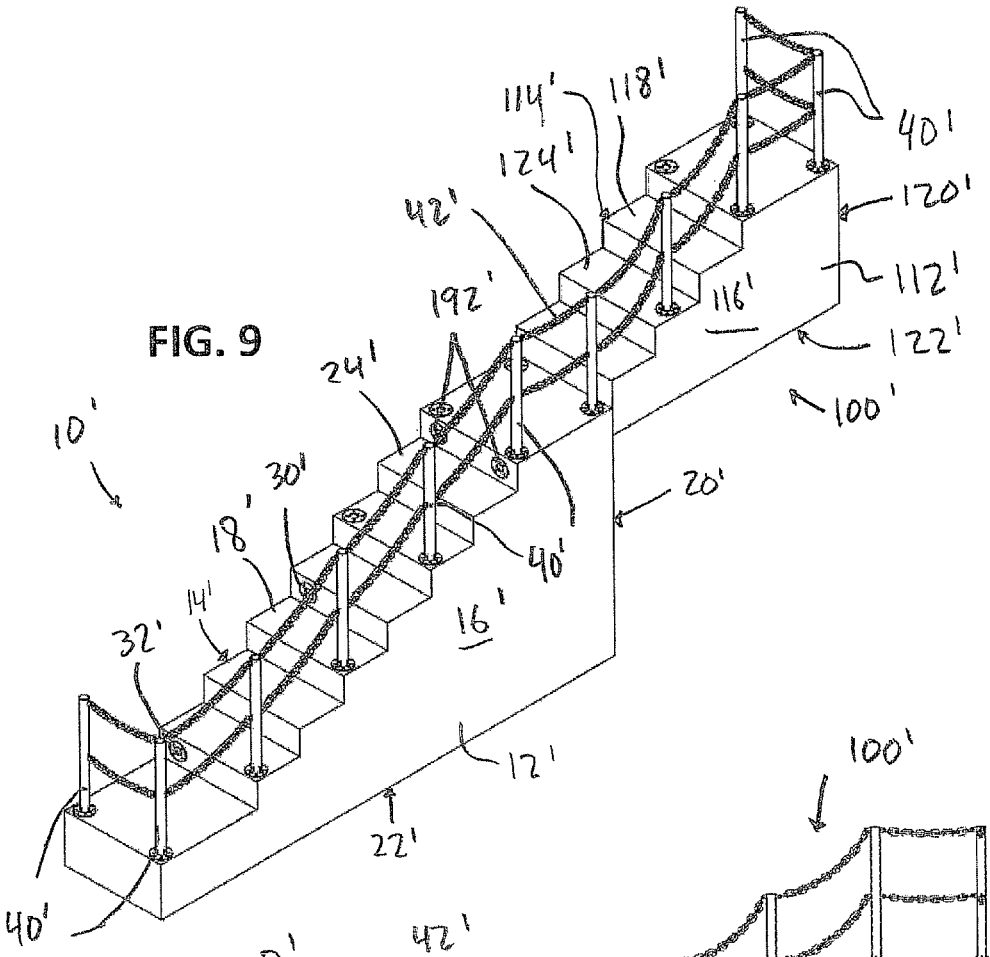
FIG. 9 is a perspective view of a compressible accommodation ladder with a ladder extension, according to another embodiment of the present invention.
Figure 10:
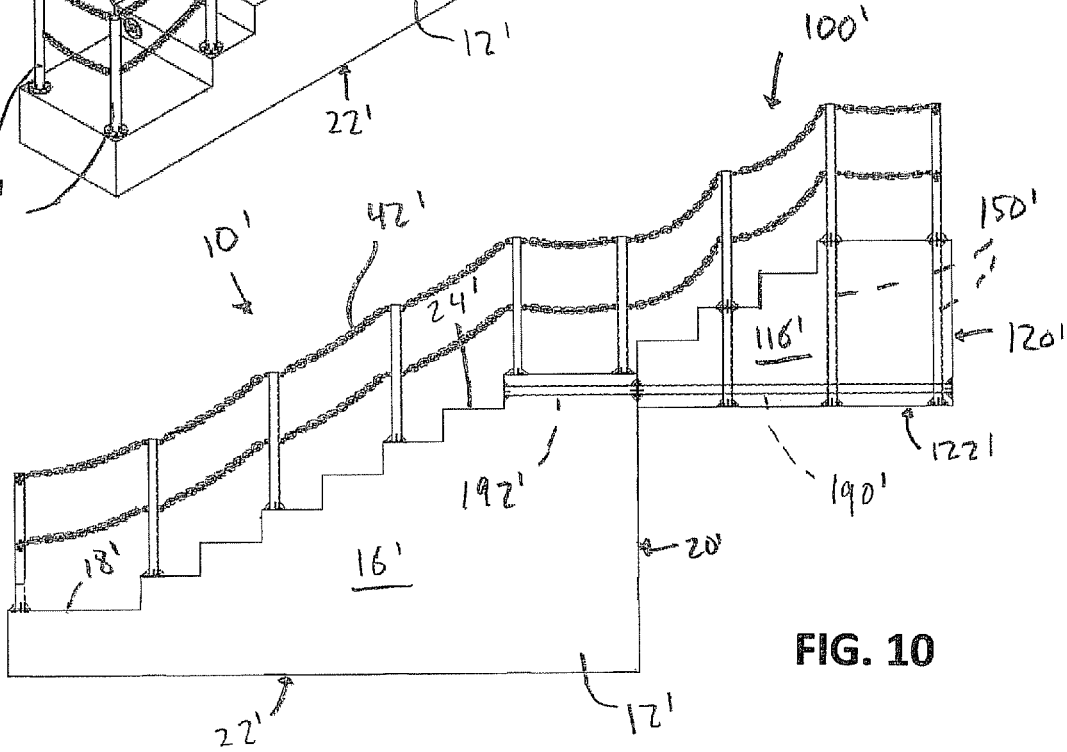
FIG. 10 is a side view of the accommodation ladder and extension of FIG. 9, with hidden components shown in broken lines.

Referring to FIGS. 9 and 10, according to another embodiment of the present invention, an accommodation ladder 10' has a ladder extension 100'. Except as described below, the accommodation ladder 10' is substantially identical to the accommodation ladder 10, with a body 12', having generally opposed first and second sides 14', 16', an upper surface 18', a rear surface 20' and a bottom surface 22'. The upper surface 18' extends between the first and second sides, and forms a staircase 24' having a plurality of steps. The body 12' is formed of a compressible material, allowing the accommodation ladder 10' to compress between the first and second sides 14', 16' of the body, thereby also functioning as a fender.

The ladder extension 100' is formed similarly to the accommodation ladder 10'. The extension 100' includes a body 112' having generally opposed first and second sides 114', 116', an upper surface 118', a rear surface 120' and a bottom surface 122'. The upper surface 118' extends between the first and second sides, and forms a staircase extension 124' having a plurality of steps. Like the body 12', the body 112' is formed of a compressible material, also allowing the extension 100' to compress between the first and second sides 114', 116' of the body 112'. Advantageously, stanchions 40' are also secured to stanchion pipes 150' extending through the body 112', allowing the safety lines 42' to be continued upward along the staircase extension 124.

The body 112' is removably secured to the body 12'. In the depicted embodiment, a pair mating pipes 190' extending through the body 112' are releasably connected to a pair of mating pipes 192' extending through the body 12'. Accordingly, the staircase extension 124' effectively continues and lengthens the staircase 24', allowing the accommodation ladder 10' to permit access to and from taller marine structures. Also, when detached, the ladder extension 110' can function independently as a smaller accommodation ladder.

Figure 11:
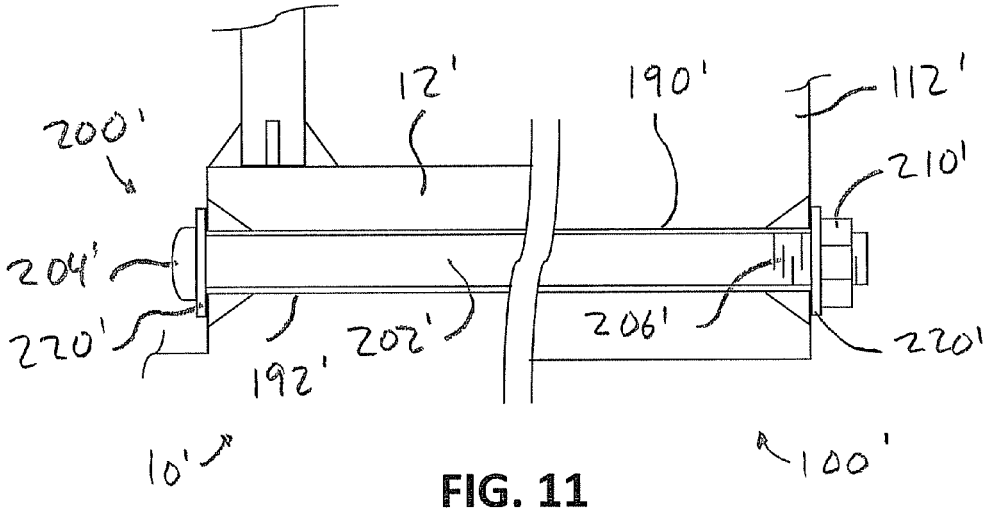
FIG. 11 is a partial side view of the accommodation ladder and extension of FIG. 9, including a connection assembly used therewith.

Referring to FIG. 11, a connection assembly 200' for connecting the mating pipes 190', 192' includes a central shaft 202' inserted therethrough. The central shaft 202' can be hollow or solid, and is preferably formed of a corrosion resistant metal. An expanded diameter head 204' is located at a first end of the shaft 202' and threads 206' are formed along a second end thereof. Once the shaft 202' is inserted through the mating pipes 190', 192', a nut 210' is threaded on the threads 206' of the shaft 202' to securely connect the bodies 12', 112', take up any clearances therebetween and place the shaft 202' in tension. Preferably, washers 220' are arranged around the shaft 202' between ends of the mating pipes 190', 192' and the head 204' and nut 210'. Although only one connection assembly 200' is shown for clarity and brevity, it will be appreciated that a pair of connection assemblies 200' would be used in each of the pairs of mating pipes 190', 192'.

Figure 12:
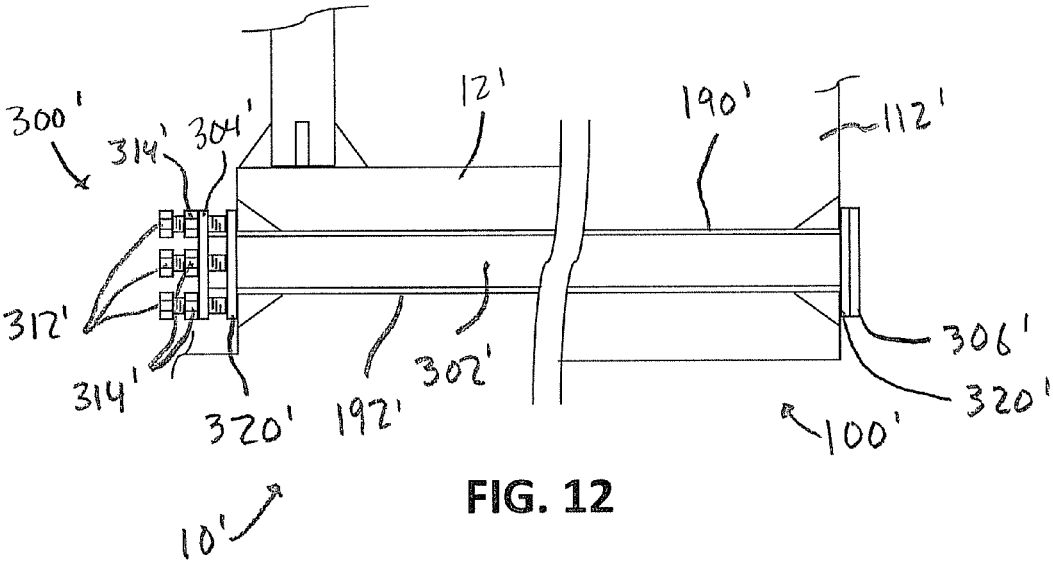
FIG. 12 is a partial side view of the accommodation ladder and extension of FIG. 9, including another embodiment of a connection assembly used therewith.

Referring to FIG. 12, an alternate connection assembly 300' for connecting mating pipes 190', 192' is used, including a central shaft 302'. The central shaft 302' has first and second flanges 304', 306' welded or otherwise secured to first and second ends thereof. It will be appreciated that at least one of the flanges 304', 306' is not secured to the shaft 302' until after insertion through the mating pipes 190', 192'. The first flange 304' includes a plurality of threaded bores therein through which a plurality of jacking bolts 312' are threaded to securely connect the bodies 12', 112', take up any clearances therebetween and place the shaft 202' in tension. To inhibit unthreading of the jacking bolts 312', each bolt 312' can be threaded through a corresponding locking nut 314' abutting the flange 304'. Again, washers 320' can be arranged on the shaft 302' between ends of the mating pipes 190', 192' and the flanges 304', 306'. Although only one connection assembly 300' is shown for clarity and brevity, it will be appreciated that a pair of connection assemblies 300' would be used in each of the pairs of mating pipes 190', 192'.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and the claims appended hereto.

What is claimed is:

1. A method of facilitating access between adjacent first and second marine structures, the method comprising:

providing an accommodation ladder comprising a body having generally opposed first and second sides extending along a length of a staircase, the body being transversely compressible between the first and second sides, an upper surface of the body extending between the first and second sides forming a staircase with a plurality of preformed ascending steps, the body being adapted for connection to a first marine structure such that the first marine structure is accessible from the staircase;

arranging the accommodation ladder with its opposed first and second sides respectively engaging the first and second marine structures, the first and second structures compressing the accommodation ladder such that the accommodation ladder forms a fender between the first and second structures.

2. The method claim 1, further comprising securing the accommodation ladder to the first marine structure.

3. The method of claim 2, further comprising selectively removing and replacing safety lines between a plurality of spaced stanchions of the accommodation ladder proximate the second marine structure to allow access to different levels of the accommodation ladder in response to relative level changes between the first and second marine structures.

4. The method of claim 3, wherein the first marine structure is a dredge and the second marine structure is a fleeting barge.

* * * * *